US011015465B2

(12) United States Patent
Reynolds et al.

(10) Patent No.: US 11,015,465 B2
(45) Date of Patent: May 25, 2021

(54) COMPRESSOR SECTION OF GAS TURBINE ENGINE INCLUDING SHROUD WITH SERRATED CASING TREATMENT

(71) Applicant: HONEYWELL INTERNATIONAL INC., Morris Plains, NJ (US)

(72) Inventors: Bruce David Reynolds, Chandler, AZ (US); John Repp, Gilbert, AZ (US); David Richard Hanson, Tempe, AZ (US); Nick Nolcheff, Chandler, AZ (US); Darrell K James, Cave Creek, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 255 days.

(21) Appl. No.: 16/363,117

(22) Filed: Mar. 25, 2019

(65) Prior Publication Data

US 2020/0308970 A1 Oct. 1, 2020

(51) Int. Cl.

| | |
|---|---|
| ***F01D 9/04*** | (2006.01) |
| ***F04D 29/68*** | (2006.01) |
| ***F04D 29/52*** | (2006.01) |

(52) U.S. Cl.

CPC ..... *F01D 9/04* (2013.01); *F04D 29/526* (2013.01); *F04D 29/685* (2013.01); *F05D 2230/10* (2013.01); *F05D 2240/10* (2013.01)

(58) Field of Classification Search

CPC ..... F04D 29/526; F04D 29/685; F01D 9/04

See application file for complete search history.

(56) References Cited

U.S. PATENT DOCUMENTS

| | | | | |
|---|---|---|---|---|
| 4,466,772 | A * | 8/1984 | Okapuu | F01D 11/08 415/173.5 |
| 4,767,266 | A | 8/1988 | Holz et al. | |
| 7,645,121 | B2 | 1/2010 | Tudor | |
| 8,439,634 | B1 * | 5/2013 | Liang | F01D 11/10 415/173.1 |
| 10,644,630 | B2 * | 5/2020 | Smith | F01D 19/00 |
| 10,830,082 | B2 * | 11/2020 | Subramaniyan | F01D 5/20 |
| 2007/0147989 | A1 | 6/2007 | Collins | |
| 2008/0044273 | A1 | 2/2008 | Khalid | |
| 2010/0014956 | A1 * | 1/2010 | Guemmer | F04D 29/685 415/9 |

(Continued)

FOREIGN PATENT DOCUMENTS

EP 2141328 A1 1/2010

*Primary Examiner* — Woody A Lee, Jr.

(74) *Attorney, Agent, or Firm* — Lorenz & Kopf, LLP

(57) ABSTRACT

A compressor section includes a shroud surface and a rotor with a blade tip that opposes the shroud surface. The rotor is configured to rotate within the shroud about an axis of rotation. Moreover, the compressor section includes a serration groove that is recessed into the shroud surface. The serration groove includes a forward portion with a forward transition and a forward surface that faces in the downstream direction. The forward transition is convexly contoured between the shroud surface and the forward surface. The serration groove includes a trailing portion with a taper surface and a trailing transition. The taper surface tapers inward as the taper surface extends from the forward surface to the trailing transition. The trailing transition is convexly contoured between the taper surface and the shroud surface.

20 Claims, 5 Drawing Sheets

(56) References Cited

U.S. PATENT DOCUMENTS

| | | | | |
|---|---|---|---|---|
| 2015/0211545 | A1 | 7/2015 | Duong et al. | |
| 2015/0022607 | A1 | 8/2015 | Perrot et al. | |
| 2015/0226078 | A1 | 8/2015 | Perrot et al. | |
| 2015/0337672 | A1* | 11/2015 | McCaffrey | F01D 11/122 415/173.1 |
| 2016/0040546 | A1* | 2/2016 | Vo | F01D 11/08 415/173.1 |
| 2016/0341058 | A1* | 11/2016 | Nishikawa | F01D 11/001 |
| 2017/0030375 | A1 | 2/2017 | Shibata et al. | |
| 2018/0010467 | A1* | 1/2018 | Zhang | F01D 5/20 |
| 2018/0094637 | A1* | 4/2018 | Van Houten | F04D 29/685 |
| 2018/0231023 | A1* | 8/2018 | Gentry | F01D 11/122 |

* cited by examiner

COMPRESSOR SECTION OF GAS TURBINE ENGINE INCLUDING SHROUD WITH SERRATED CASING TREATMENT

TECHNICAL FIELD

The following relates to a compressor section of a gas turbine engine and, more particularly, to a compressor section of a gas turbine engine that includes a shroud with a serrated casing treatment.

BACKGROUND

Gas turbine engines are often used in aircraft, among other applications. For example, gas turbine engines used as aircraft main engines may provide propulsion for the aircraft but are also used to provide power generation. It is desirable for such propulsion systems to deliver high performance in a compact, lightweight configuration. This is particularly important in smaller jet propulsion systems typically used in regional and business aviation applications as well as in other turbofan, turboshaft, turboprop and rotorcraft applications.

The compressor section may be configured for increasing cycle pressure ratios to improve engine performance. Aerodynamic loading or rotational speeds may be increased, but these changes may reduce the compressor stall margin, causing engine instability, increased specific fuel consumption, and/or increased turbine operating temperatures. Stage counts may be increased, but this may negatively impact weight, volume, and cost. Also, some features intended to improve engine performance may negatively affect the robustness of the compressor section.

Accordingly, there is a need for an improved compressor stage that achieves superior surge and stability margins, that maintains high efficiency potential for the gas turbine engine, and that is also highly robust. There is also a need for an improved gas turbine engine with this type of compressor stage. Moreover, there is a need for improved methods of manufacturing these compressor stages for gas turbine engines. Furthermore, other desirable features and characteristics of the present disclosure will become apparent from the subsequent detailed description and the appended claims, taken in conjunction with the accompanying drawings and this background section.

BRIEF SUMMARY

In one embodiment, a compressor section of a gas turbine engine is disclosed that defines a downstream direction and an upstream direction. The compressor section includes a shroud with a shroud surface. The compressor section also includes a rotor rotatably supported within the shroud. The rotor includes a blade that radially terminates at a blade tip. The blade tip opposes the shroud surface. The rotor is configured to rotate within the shroud about an axis of rotation. Moreover, the compressor section includes a serration groove that is recessed into the shroud surface. The serration groove includes a forward portion with a forward transition and a forward surface that faces in the downstream direction. The forward transition is convexly contoured between the shroud surface and the forward surface. The serration groove includes a trailing portion with a taper surface and a trailing transition. The taper surface tapers inward as the taper surface extends from the forward surface to the trailing transition. The trailing transition is convexly contoured between the taper surface and the shroud surface.

In another embodiment, a method of manufacturing a shroud of a gas turbine engine is disclosed that includes forming a shroud surface of the shroud. The shroud surface is configured to oppose a blade tip of a rotor rotatably supported within the shroud. The shroud surface defines a downstream direction. The method also includes forming a serration groove that is recessed into the shroud surface to include a forward portion with a forward transition and a forward surface that faces in the downstream direction. The forward transition is convexly contoured between the shroud surface and the forward surface. The serration groove includes a trailing portion with a taper surface and a trailing transition. The taper surface tapers in an inward direction as the taper surface extends from the forward surface to the trailing transition. The trailing transition is convexly contoured between the taper surface and the shroud surface.

In yet another embodiment, a compressor section of a gas turbine engine is disclosed. The compressor section defines a downstream direction and an upstream direction. Also, the compressor section includes a shroud with a shroud surface and a rotor rotatably supported within the shroud. The rotor includes a blade that radially terminates at a blade tip. The blade tip is curved between a forward end of the blade tip and an aft end of the blade tip. The blade tip opposes the shroud surface. The rotor is configured to rotate within the shroud about an axis of rotation. Also, the compressor section includes a casing treatment with a plurality of serration grooves that are recessed into the shroud surface. The serration grooves respectively include a forward portion and a trailing portion. The forward portion including a forward transition and a forward surface that faces in the downstream direction. The forward transition is convexly contoured between the shroud surface and the forward surface. The trailing portion includes a taper surface and a trailing transition. The taper surface tapers inward as the taper surface extends from the forward surface to the trailing transition. The trailing transition is convexly contoured between the taper surface and the shroud surface. The forward transition intersects the shroud surface at a first intersection and intersects the forward surface at a second intersection. The forward surface intersects the taper surface at a third intersection. The taper surface intersects the trailing transition at a fourth intersection. The trailing transition intersects the shroud surface at a fifth intersection. The forward surface and the shroud surface define an imaginary sixth intersection, and the taper surface and the shroud surface define an imaginary seventh intersection. The forward portion has a first dimension measured from the first intersection to the sixth intersection. The trailing portion has a second dimension and a third dimension measured along the taper surface. The second dimension is measured from the third intersection to the seventh intersection, and the third dimension is measured from the fourth intersection to the seventh intersection. The first dimension is between approximately six percent (6%) and thirteen percent (13%) of the second dimension. The third dimension is between approximately twenty percent (20%) and forty percent (40%) of the second dimension.

Furthermore, other desirable features and characteristics of the present disclosure will become apparent from the above background, the subsequent detailed description, and the appended claims, taken in conjunction with the accompanying drawings.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

The present disclosure provides a turbomachine, such as a compressor section for a gas turbine engine. The compressor section includes a rotor blade with an outer radial edge or blade tip that radially opposes a shroud. The shroud may include one or more casing treatments, such as one or more grooves that are recessed radially into the inner shroud surface. The groove(s), in at least one axial cross section of the compressor section, may be generally shaped to resemble a triangle, wedge, sawtooth, and/or serration.

The casing treatment may also include smoothly blended transitions between the shroud surface and the internal surfaces of the groove. The transitions may be rounded and convexly contoured, similar to the profile of an external fillet. The dimensions of the contoured transitions and dimensional relationships of the transitions with respect to other areas of the shroud are controlled, tailored, and determined according to various considerations discussed below. Accordingly, the rotor tip and opposing shroud configuration are configured to provide a uniquely robust compressor section that provides high efficiency and operability throughout a wide range of operating conditions—including "near-stall" conditions and conditions involving "rubbing" between the rotor blade and the shroud surface.

Figure 1:
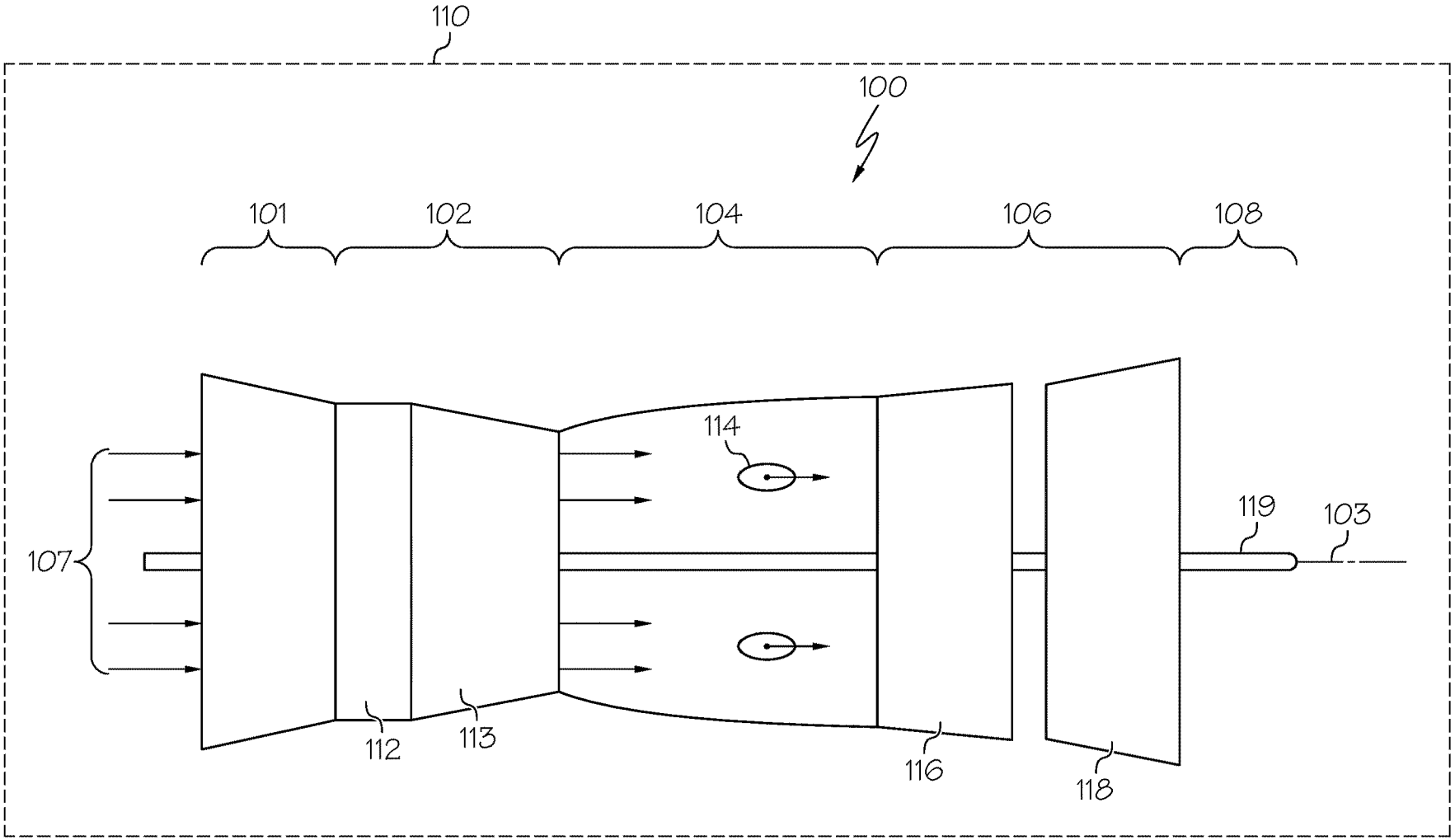
FIG. 1 is a schematic view of a gas turbine engine according to example embodiments of the present disclosure.

Turning now to FIG. 1, a functional block diagram of an exemplary gas turbine engine 100 is depicted. The engine 100 may be included on a vehicle 110 of any suitable type, such as an aircraft, rotorcraft, marine vessel, train, or other vehicle, and the engine 100 can propel or provide auxiliary power to the vehicle 110.

In some embodiments, the depicted engine 100 may be a single-spool turbo-shaft gas turbine propulsion engine; however, the exemplary embodiments discussed herein are not intended to be limited to this type, but rather may be readily adapted for use in other types of turbine engines including but not limited to two-spool engines, three-spool engines, turbofan and turboprop engines or other turbomachines.

The engine 100 may generally include an intake section 101, a compressor section 102, a combustion section 104, a turbine section 106, and an exhaust section 108, which may be arranged along a longitudinal axis 103. A downstream direction through the engine 100 may be defined generally along the axis 103 from the intake section 101 to the exhaust section 108. Conversely, an upstream direction is defined from the exhaust section 108 to the intake section 101.

The intake section 101 may receive an intake airstream indicated by arrows 107 in FIG. 1. The compressor section 102, may include one or more compressor stages that draw air 107 downstream into the engine 100 and compress the air 107 to raise its pressure. In the depicted embodiment, the compressor section 102 includes two stages: a low-pressure compressor stage 112 and a high-pressure compressor stage 113. The compressor stages 112, 113 may be disposed sequentially along the axis 103 with the low-pressure compressor stage 112 disposed upstream of the high-pressure compressor stage 113. It will be appreciated that the engine 100 could be configured with more or less than this number of compressor stages.

The compressed air from the compressor section 102 may be directed into the combustion section 104. In the combustion section 104, which includes a combustor assembly 114, the compressed air is mixed with fuel supplied from a non-illustrated fuel source. The fuel-and-air mixture is combusted in the combustion section 104, and the high energy combusted air mixture is then directed into the turbine section 106.

The turbine section 106 includes one or more turbines. In the depicted embodiment, the turbine section 106 includes two turbines: a high-pressure turbine 116 and a low-pressure turbine 118. However, it will be appreciated that the engine 100 could be configured with more or less than this number of turbines. No matter the particular number, the combusted air mixture from the combustion section 104 expands through each turbine 116, 118, causing it to rotate at least one shaft 119. The combusted air mixture is then exhausted via the exhaust section 108. The power shaft 119 may be used to drive various devices within the engine 100 and/or within the vehicle 110.

Figure 2:
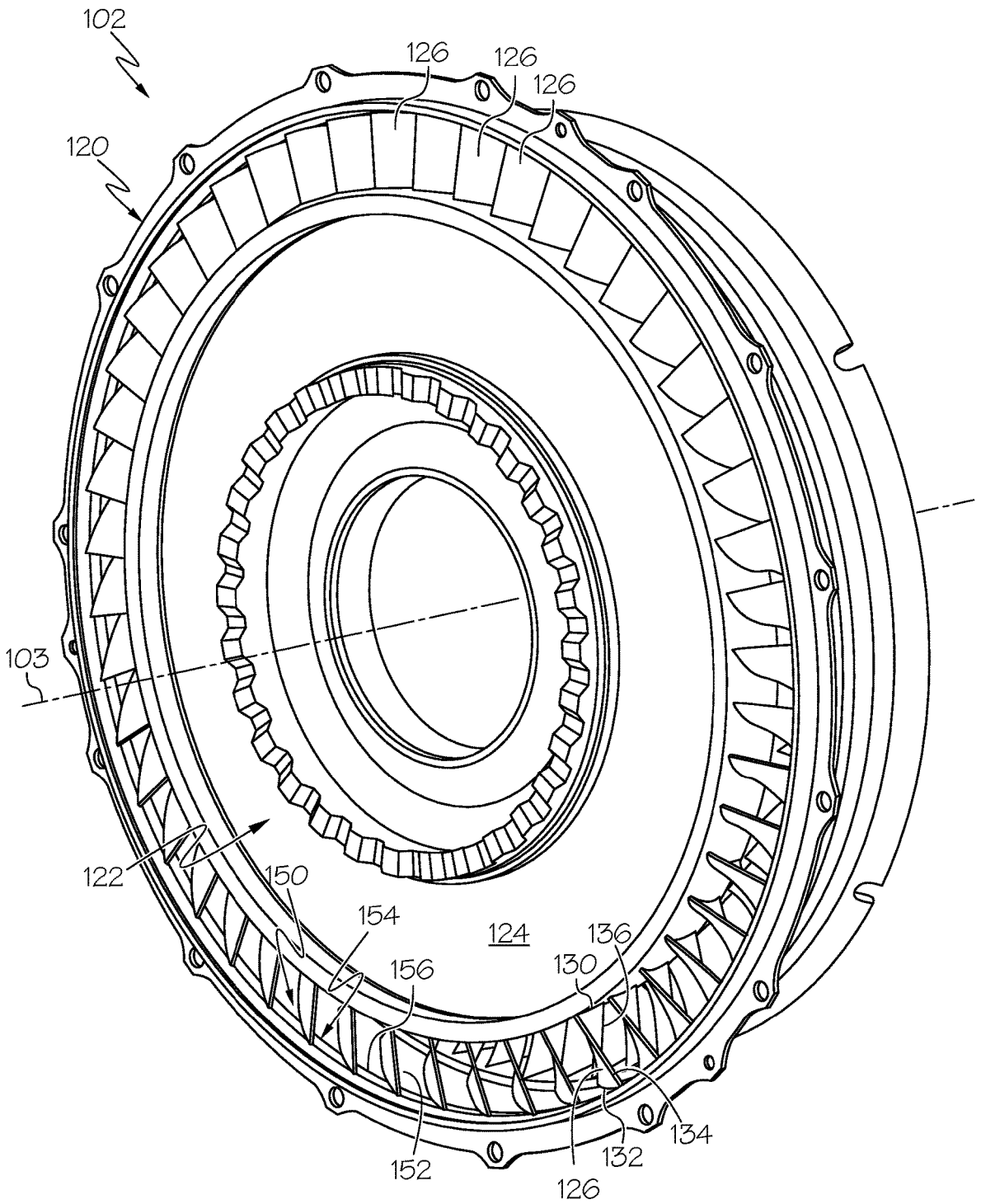
FIG. 2 is a perspective view of a compressor stage of the gas turbine engine of FIG. 1 according to example embodiments.

Referring now to FIG. 2, the compressor section 102 will be discussed in greater detail according to example embodiments of the present disclosure. Specifically, the high-pressure compressor stage 113 is shown as an example; however, it will be appreciated that the features described may be included in the low-pressure compressor stage 112. It will be appreciated that FIG. 2 is merely an example and that the compressor section 102 may vary from the illustrated embodiment without departing from the scope of the present disclosure. For example, the curvics shown in FIG. 2 are optional features.

The compressor section 102 may include a case 120. The case 120 may be hollow and cylindrical in some embodiments. The case 120 may also include a shroud 150 with a shroud surface 152 (e.g., an inner diameter surface of the shroud 150). The shroud surface 152 may define a downstream direction.

The compressor section 102 may also include a rotor 122. The rotor 122 may include a disk 124. The disk 124 may be supported on the shaft 119 (FIG. 1). The disk 124 may be centered on the axis 103. The rotor 122 may further include a plurality of blades 126, which extend radially from the disk 124 and which may be spaced apart in a circumferential direction about the axis 103. The blades 126 of the rotor 122 may radially oppose the shroud surface 152. The rotor 122, including the disk 124 and the plurality of blades 126, may rotate about the axis 103 (i.e., the axis of rotation) relative to the case 120, the shroud 150, and the shroud surface 152 to generate an aft axial fluid flow (fluid flow in the downstream direction) through the compressor section 102 as will be discussed.

An inner radial end 130 of the blade 126 may be fixedly attached to the outer diameter of the disk 124. The blade 126 radially terminates at an outer radial edge or blade tip 132. The blade tip 132 is radially spaced apart from the inner radial end 130. The blade 126 further includes a leading edge 134, which extends radially between the inner radial end 130 and the blade tip 132. Furthermore, the blade 126 includes a trailing edge 136, which extends radially between the inner radial end 130 and the blade tip 132, and which is spaced downstream of the leading edge 134 relative to the longitudinal axis 103. The blade tip 132 extends between the leading edge 134 and the trailing edge 136 and extends generally along the longitudinal axis 103. As shown in FIG. 2, the blades 126 may exhibit complex, three-dimensional curved surfaces and may be shaped so as to have a degree of helical twist about its respective radial axis and/or sweeping curvature in the downstream direction.

Moreover, the shroud 150 may include a casing treatment 154. The casing treatment 154 may be a feature included on the shroud surface 152. As will be discussed, the casing treatment 154 may include one or more grooves 156 that are recessed radially into the shroud surface 152. The casing treatment 154 is configured to resist a reverse axial fluid flow (i.e., fluid flow in the upstream direction) during near-stall operating conditions of the compressor section 102. In other words, the casing treatment 154 increases the stall margin of the compressor section 102 and/or reduces a deficit in the axial fluid flow, especially proximate the leading edge 134.

Figure 3:
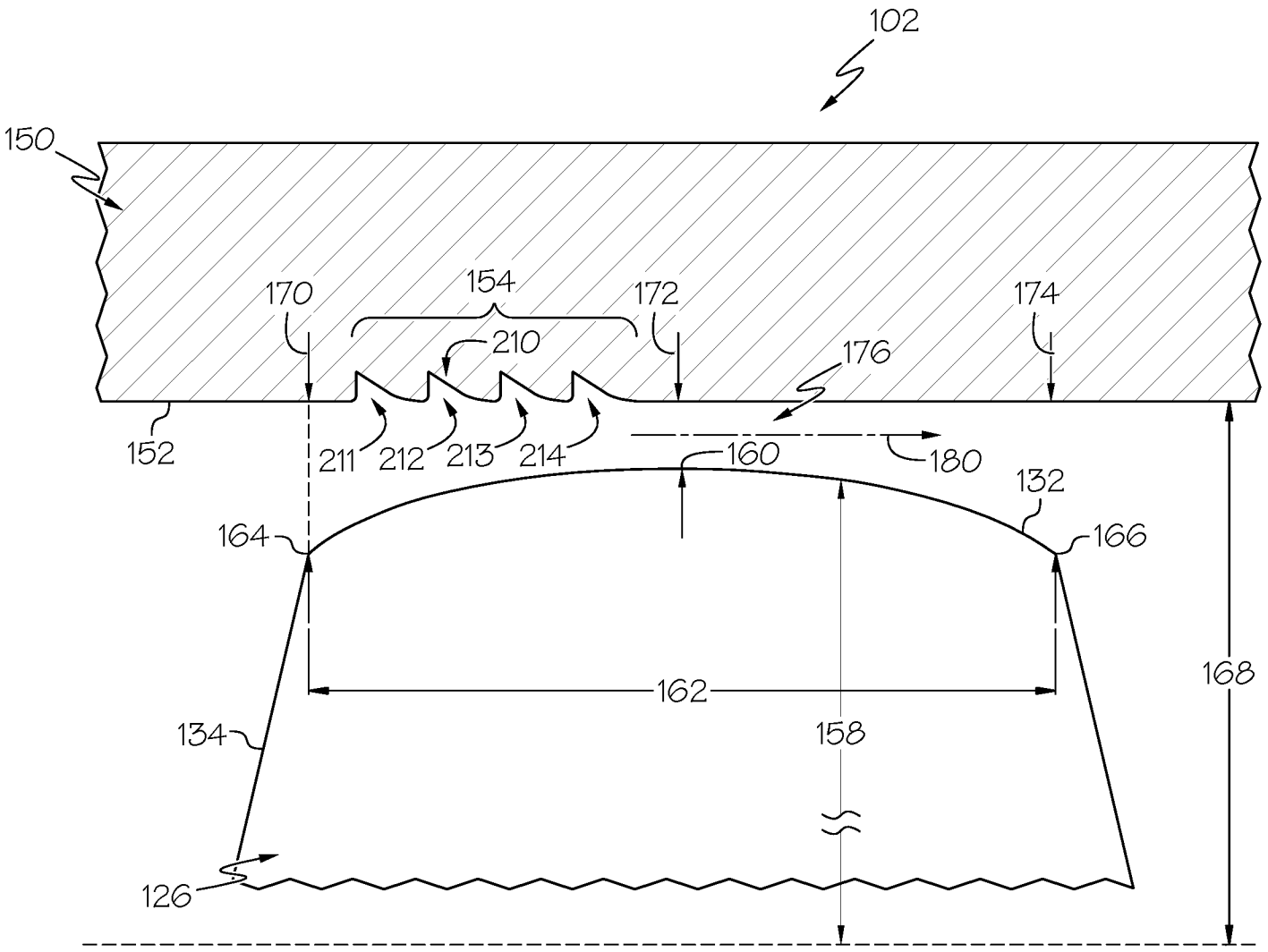
FIG. 3 is an axial cross section view of the compressor stage of FIG. 2 according to example embodiments.

Referring now to FIG. 3, additional features of the compressor section 102 will be discussed. A longitudinal profile of the blade tip 132 is shown in relation to the shroud 150. In FIG. 3, only half the axial cross-sectional view of the compressor section 102 is shown; the other half may be substantially rotationally symmetric about the axis of rotation 103. Additionally, certain aspects of the engine 100 may not be shown in FIG. 2, or only schematically shown, for clarity in the relevant description of exemplary embodiments. One skilled in the art will understand that FIG. 3 illustrates an example embodiment of the compressor section 102, and that other features may be included and/or features may be different in other embodiments of the present disclosure.

The leading edge 134 and the trailing edge 136 are also shown projected onto the plane of the cross section of FIG. 3. As shown, the blade tip 132 may include a forward end 164 (at the transition between the leading edge 134 and the blade tip 132) and an aft end 166 (at the transition between the blade tip 132 and the trailing edge 136). The blade 126 may also define a blade tip chord length 162 (an axial chord length) that is measured parallel to the longitudinal axis 103 from the forward end 164 to the aft end 166.

The blade tip 132 may be curved in some embodiments between the forward end 164 and the aft end 166, as represented in the axial cross-section of FIG. 3. The blade tip 132 may bow outward radially between the forward end 164 and the aft end 166 so as to define a crown area 160. In some embodiments, a radius 158 of the blade tip 132 (here, measured normal to the longitudinal axis 103 from the axis 103 to the blade tip 132) may be nonconstant. As such, the radius varies along the longitudinal axis 103. Moving in the downstream direction, the radius 158 may gradually increase from the forward end 164 to the crown area 160, and the radius 158 may gradually decrease from the crown area 160 to the aft end 166 of the blade tip 132. Thus, the crown area 160 may have the largest radius 158 of the blade tip 132, and the profile of the blade tip 132 may contour convexly and continuously along the longitudinal axis 103 from the leading edge 134 to the trailing edge 136. However, it will be appreciated that the blade tip 132 may have a different configuration from the illustrated crowned profile without departing from the scope of the present disclosure. In some alternative embodiments, for example, the radius 158 may remain substantially constant along at least part of the blade tip 132.

The blade tip 132 may also, in some embodiments, be configured for a frustoconically shaped shroud surface 152. The blade tip 132 may be curved (i.e., nonlinear) with dimensions that correspond to those of the shroud surface 152. The blade tip 132 may be crowned and may bow outward between the forward end 164 and the aft end 166 so as to define the crown area 160.

Furthermore, the shroud 150 may be an annular component with the shroud surface 152 defined on an inner diameter thereof. The shroud surface 152 may be centered about the axis 103. The shroud 150 may define a shroud radius 168 measured normal to the axis 103, from the axis 103 to the shroud surface 152. As illustrated in FIG. 3, the shroud radius 168 may remain substantially constant along the longitudinal axis 103 across a majority of the shroud surface 152. In other words, the shroud surface 152 may be substantially cylindrical with a constant shroud radius 168 (i.e., the shroud surface 152 may resemble a right circular cylinder). In other embodiments of the present disclosure, the shroud 150 may be frustoconic in shape and tapered such that the shroud radius 168 changes gradually along the longitudinal axis 103.

A clearance region 176 is defined between the blade tip 132 and the radially opposing region of the shroud surface 152. Clearance dimensions (measured radially between the shroud surface 152 and the blade tip 132) may vary along the longitudinal axis 103 from the leading edge 134 to the trailing edge 136. A crown clearance 172 is defined between the crown area 160 and the shroud surface 152 and may represent the smallest clearance. A leading clearance 170 is defined between the forward end 164 and the shroud surface 152, a trailing clearance 174 is defined between the aft end 166 and the shroud surface 152, and either may represent the largest clearance dimension between the blade tip 132 and the shroud surface 152. In additional embodiments, the maximum and minimum tip clearances may occur at any position between the forward end 164 and the aft end 166. Also, the minimum clearance of the clearance region 176 may be located approximately at a mid-chord position (i.e., half way between the forward end 164 and the aft end 166); however, this minimum clearance region may be disposed at any position between the forward end 164 and the aft end 166.

Accordingly, as shown in FIG. 3, the clearance region 176 may have a crowned or crown-like shape. In this case, the clearance region 176 is crowned because the amount of clearance gradually increases both upstream of the crown area 160 and downstream of the crown area 160. In some embodiments, the crown clearance 172 may be between approximately forty percent (40%) to sixty percent (60%) of the leading clearance 170 and/or forty percent (40%) to sixty percent (60%) of the trailing clearance 174. It will be appreciated that the clearance region 176 may be crowned when generally at the design operating condition of the compressor, which for an aircraft propulsion engine, may be a sea-level takeoff, cruise, and/or approach condition.

Rotation of the rotor 122 about the axis 103 generates aft axial fluid flow through the clearance region 176 in the downstream direction (i.e., in a direction from compressor inlet toward compressor outlet or, in other words, from left to right as shown in FIG. 3). In contrast, reverse axial flow refers to fluid flow generally in an opposite direction (from right to left in FIG. 3). Broken line 180 in FIG. 3 represents a flow axis for downstream flow through the clearance region 176. In the illustrated embodiment, the flow axis 180 is substantially parallel to the axis of rotation 103; however, it will be appreciated that the flow axis 180 may be disposed at a positive angle relative to the axis of rotation 103 (e.g., in embodiments in which the shroud surface 152 is frustoconic in shape). It will be appreciated that this is a simplified representation of the flow mechanics through the clearance region 176. In reality, the rotor 122 may generate aft flow with some flow through the clearance region 176 locally reversed. Features of the present disclosure may prevent and/or limit the reverse flow, thereby avoiding stall and/or surge conditions.

As mentioned above, the shroud 150 may include a casing treatment 154. In some embodiments, the casing treatment 154 includes a grooved section 210 with a plurality of grooves that are recessed radially into the shroud surface 152. In some embodiments, the grooved section 210 may include a first groove 211, a second groove 212, a third groove 213, and a fourth groove 214. The grooves 211-214 may be substantially similar to each other except as noted. It will be appreciated that FIG. 3 illustrates example embodiments of the casing treatment 154 and that other embodiments may differ without departing from the scope of the present disclosure. The grooves 211-214 may resist reverse axial fluid flow through the clearance region 176. Accordingly, the grooves 211-214 may improve operations throughout a wide range of conditions including "near-stall" conditions.

One or more of the grooves 211-214 may have a cross-sectional profile resembling a triangle, wedge, sawtooth, and/or serration. In some embodiments, the grooves 211-214 may substantially resemble a right triangle. Also, in some embodiments, the grooves 211-214 may be annular and may extend continuously about the axis 103. Thus, these may be considered circumferential grooves 211-214 that are consistent and continuous about the axis 103.

The grooves 211-214 may be spaced axially apart evenly along the shroud surface 152, with the first groove 211 disposed in the forward-most position and the fourth groove 214 disposed in the aft-most position. At least one of the grooves 211-214 may be axially disposed to radially oppose the blade tip 132. For example, as shown in FIG. 3, each of the grooves 211-214 is axially positioned to oppose the blade tip 132. Furthermore, in some embodiments, the grooves 211-214 may be axially positioned upstream of the crown area 160 of the blade tip 132.

The first groove 211 will be discussed in detail with reference to FIG. 4, and it will be appreciated that the second, third, and fourth grooves 212-214 may include similar features. A broken line 251 extends axially from an area of the shroud surface 152 immediately upstream of the groove 211 to an area of the shroud surface 152 immediately downstream of the groove 211 for reference purposes. As shown, the groove 211 may include a leading portion 220 and a trailing portion 222.

The leading portion 220 may include a forward surface 224 that faces substantially in the downstream direction. As shown in the axial cross-section of FIG. 4, the forward surface 224 may be substantially flat and may be disposed substantially normal to the flow axis 180 and/or normal to the axis of rotation 103. In other embodiments, the forward surface 224 may be disposed substantially normal to the flow axis 180 and may be disposed at non-normal angle relative to the axis of rotation 103 (e.g., in embodiments in which the shroud surface 152 is frustoconic in shape). In additional embodiments, the forward surface 224 may be within twenty degrees (20°) of a line tangent to crown area 160 of the blade tip 132.

The leading portion 220 may also include a forward transition 226. The forward transition 226 may be convexly contoured (i.e., blended) between the shroud surface 152 disposed immediately upstream of the groove 211 and the forward surface 224. In some embodiments, the forward transition 226 may define a radius 250. The radius 250 may be substantially constant in some embodiments. However, in other embodiments, the radius 250 may be nonconstant.

The trailing portion 222 may include a taper surface 228 that tapers inward radially as the taper surface 228 extends in downstream direction. As shown in the axial cross-section of FIG. 4, the taper surface 228 may be substantially flat and may be disposed at a positive angle (e.g., an acute angle) 232 relative to the forward surface 224. In some embodiments, the angle 232 may be at least forty-five degrees (45°).

The trailing portion 222 may further include a trailing transition 230. The trailing transition 230 may be convexly contoured (i.e., blended) between the taper surface 228 and the shroud surface 152 disposed immediately downstream of the groove 211. As shown, the trailing transition 230 may have a nonconstant radius; however, in other embodiments the trailing transition 230 may have a constant radius.

Figure 4:
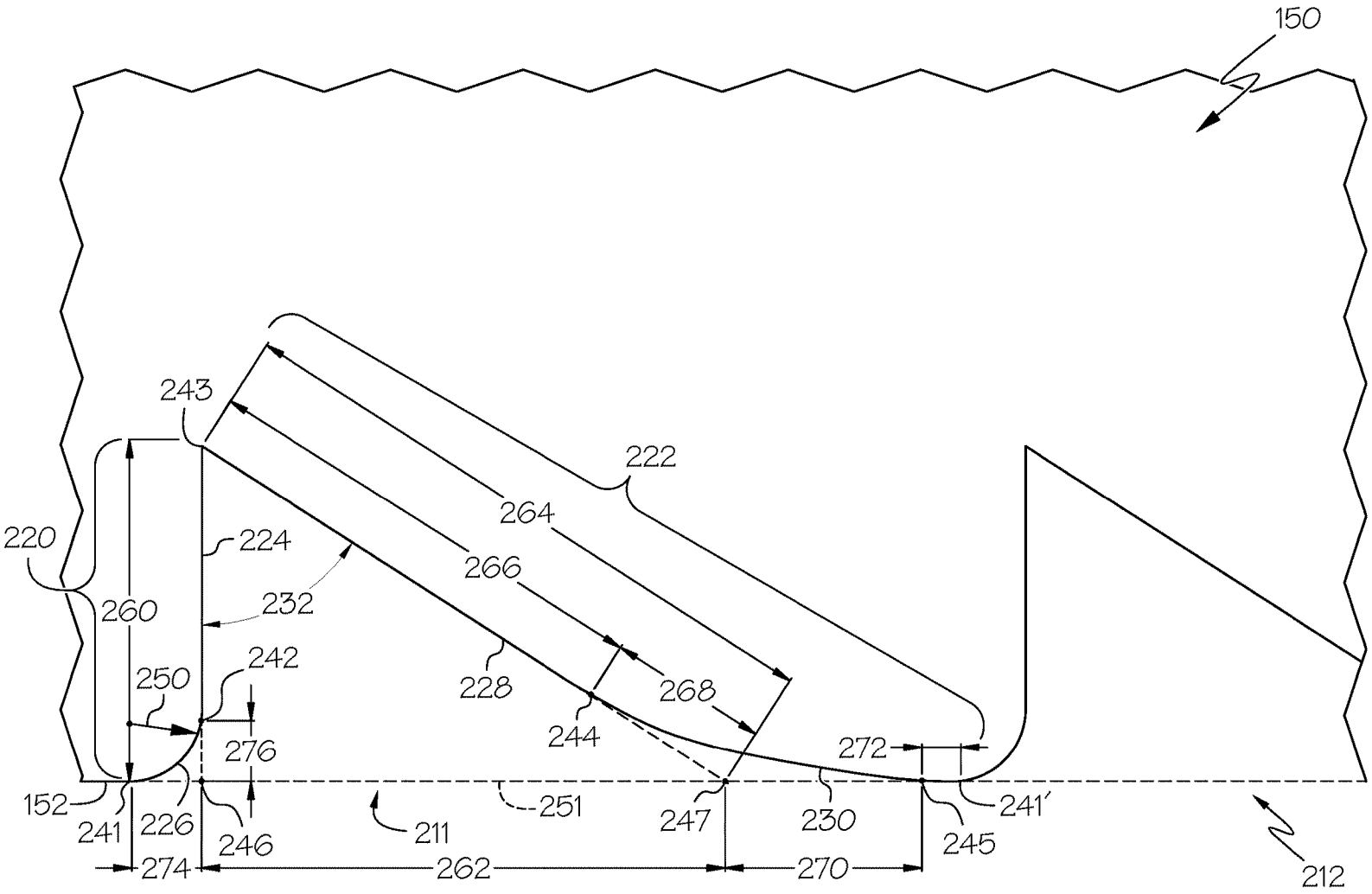
FIG. 4 is an axial cross section view of a shroud of the compressor stage of FIG. 3.

As shown in the cross-section of FIG. 4, the forward transition 226 may intersect the shroud surface 152 at a first intersection 241. The forward transition 226 may intersect the forward surface 224 at a second intersection 242. The forward surface 224 may intersect the taper surface 228 at a third intersection 243. The taper surface 228 may intersect the trailing transition 230 at a fourth intersection 244. The trailing transition 230 may intersect the shroud surface 152 at a fifth intersection 245. Furthermore, as shown in FIG. 4, the forward surface 224 and the shroud surface 152 may define an imaginary sixth intersection 246 Likewise, the taper surface 228 and the shroud surface 152 may define an imaginary seventh intersection 247.

The trailing transition 230 may be significantly more gradual than the forward transition 226. Stated differently, the forward transition 226 may be significantly more abrupt than the trailing transition 230. Accordingly, benefit from the casing treatment 154 may be provided for increasing the stall margin, and yet the compressor section 102 may be highly robust if there is rubbing between the shroud 150 and the blade tip 132.

Referring now to FIGS. 3 and 4, the groove 211 may exhibit various dimensional relationships that make the compressor section 102 highly robust. For example, the minimum radius 250 of the forward transition 226 may be significantly smaller than the minimum radius of the trailing transition 230. In some embodiments, for example, the minimum radius 250 of the forward transition 226 may be at most two-fifths (2/5) of the minimum radius of the trailing transition 230.

Dimensions of the groove 211 may also be expressed in relation to the imaginary sixth and seventh intersections 246, 247. For example, the groove 211 may have a groove depth dimension 260 measured radially from the sixth intersection 246 to the third intersection 243 (i.e., measured radially from the shroud surface 152 to the third intersection 243). The depth dimension 260 may be between approximately three percent (3%) and twenty percent (20%) of the blade tip chord length 162. In some embodiments, the depth dimension 260 may be between approximately five percent (5%) and fifteen percent (15%) of the blade tip chord length 162. Additionally, in some embodiments, the depth dimension 260 may be approximately eight percent (8%) of the blade tip chord length 162.

Moreover, the groove 211 may have a groove length dimension 262 measured axially from the sixth intersection 246 to the seventh intersection 247. The groove length dimension 262 may be between three percent (3%) and twenty percent (20%) of the blade tip chord length 162. In some embodiments, the length dimension 262 may be between approximately six percent (6%) and eighteen percent (18%) of the blade tip chord length 162. Additionally, in some embodiments, the length dimension 262 may be approximately nine percent (9%) of the blade tip chord length 162.

Furthermore, the groove 211 may have a first taper length dimension 264 measured parallel to the taper surface 228 from the third intersection 243 to the seventh intersection 247. The first taper length dimension 264 may be between four percent (4%) and twenty-nine percent (29%) of the blade tip chord length 162. In some embodiments, the first taper length dimension 264 may be between approximately seven percent (7%) and twenty-four percent (24%) of the blade tip chord length 162. Also, in some embodiments, the first taper length dimension 264 may be approximately twelve percent (12%) of the blade tip chord length 162.

Additionally, the groove 211 may have a second taper length dimension 266 measured parallel to the taper surface 228 from the third intersection 243 to the fourth intersection 244. The difference between the first taper length dimension 264 and the second taper length dimension 266 may be referred to as a third taper length dimension 268. The third taper length dimension 268 may be between approximately five percent (5%) and fifty-five percent (55%) of the first taper length dimension 264. In some embodiments, the third taper length dimension 268 may be between approximately twenty percent (20%) and forty percent (40%) of the first taper length dimension 264. Also, in some embodiments, the third taper length dimension 268 may be approximately thirty percent (30%) of the first taper length dimension 264.

A first axial distance 270 measured parallel to the axis 103 between the seventh intersection 247 and the fifth intersection 245 may be between approximately five percent (5%) and fifty-five percent (55%) of the first taper length dimension 264. Also, the first axial distance 270 may be between approximately twenty percent (20%) and forty percent (40%) of the first taper length dimension 264. Also, in some embodiments, the first axial distance 270 may be approximately thirty percent (30%) of the first taper length dimension 264.

Furthermore, a second axial distance 272 measured parallel to the axis 103 between the fifth intersection 245 and the adjacent first intersection 241' of the neighboring second groove 212 may be greater than zero percent (0%) of the groove length dimension 262. Also, the second axial distance 272 may be greater than five percent (5%) of the groove length dimension 262. In some embodiments, the second axial distance 272 may be approximately ten percent (10%) of the groove length dimension 262.

Moreover, a third axial distance 274 measured parallel to the axis 103 between the first intersection 241 and the sixth intersection 246 may be between approximately five percent (5%) and fifty-five percent (55%) of the first taper length dimension 264. The third axial distance 274 may be approximately six percent (6%) and thirteen percent (13%) of the first taper length dimension 264. In some embodiments, the third axial distance 274 may be approximately ten percent (10%) of the first taper length dimension 264.

Also, a radial distance 276 measured normal to the axis 103 between the sixth intersection 246 and the second intersection 242 may be between approximately five percent (5%) and fifty-five percent (55%) of the first taper length dimension 264. The radial distance 276 may be approximately six percent (6%) and thirteen percent (13%) of the first taper length dimension 264. In some embodiments, the radial distance 276 may be approximately ten percent (10%) of the first taper length dimension 264.

One or more dimensions of the grooves 211-214 may be determined according to the dimensions of the gap clearance region 176. For example, the forward and/or trailing transitions 226, 230 may be larger if the crown clearance 172 is smaller. This is because, with a smaller crown clearance 172, there is less likelihood of reverse axial fluid flow; therefore, the transitions 226, 230 may be larger to better distribute forces in the event of rubbing. In contrast, the forward and/or trailing transitions 226, 230 may be smaller if the crown clearance 172 is larger. This is because, with a larger crown clearance 172, there may be more likelihood of reverse axial fluid flow, and the transitions 226, 230 may be smaller to increase stall margin.

The shroud 150 may be manufactured in various ways within the scope of the present disclosure. For example, the shroud 150 may be formed initially without the grooves 211-214, and then material may be removed from the shroud 150 (e.g., with one or more cutting tools) to form the grooves 211-214. In this embodiment, a lathe or lathe-like machine may be used for forming the grooves 211-214. Also, in this embodiment, the angle 232 may be formed according to the fillet radius of the cutting tool. The forward and trailing transitions 226, 230, in contrast, may be formed by controlling relative movement of the shroud 150 and cutting tool (e.g., with computerized machine controls). Additionally, in some embodiments, a template may be used for forming at least two of the grooves 211-214 concurrently.

In additional embodiments, the shroud 150 may be formed with the grooves 211-214 included therein. The shroud surface 152 and the grooves 211-214 may be formed concurrently in a single manufacturing process. For example, the shroud 150 and grooves 211-214 may be formed using an additive manufacturing process, such as 3-D printing. In these embodiments, the shroud 150 may be formed layer-by-layer along the axis 103, beginning at the forward end and ending at the aft end. As such, the forward transition 226 and forward surface 224 may be formed before the taper surface 228 and the trailing transition 230, thereby ensuring that there is sufficient mechanical support for these features during the manufacturing process.

Furthermore, in the illustrated embodiments, the casing treatment 154 may be integral to the shroud 150 and formed directly within the material of the shroud 150. However, in other embodiments, the grooves 211-214 may be formed on an arcuate insert pierce, which is then attached to an inner surface of a supporting piece of the shroud 150. Thus, the shroud 150 may be a unitary, monolithic, one-piece member, or the shroud 150 may be assembled from multiple pieces.

Additionally, the grooves 211-214 may be formed in abradable material of the shroud 150. As such, the abradable material may be intended to wear away, for example, in the event of contact with the blade tip 132. However, the forward and/or trailing transitions 226, 230 may distribute contact forces effectively so that a significant portion of the grooves 211-214 are likely to remain even after other portions abrade. In other embodiments, the grooves 211-214 may be formed in non-abradable material of the shroud 150. In these embodiments, the forward and/or trailing transitions 226, 230 may distribute forces effectively such that the blade tip 132 is unlikely to be damaged.

Figure 5:
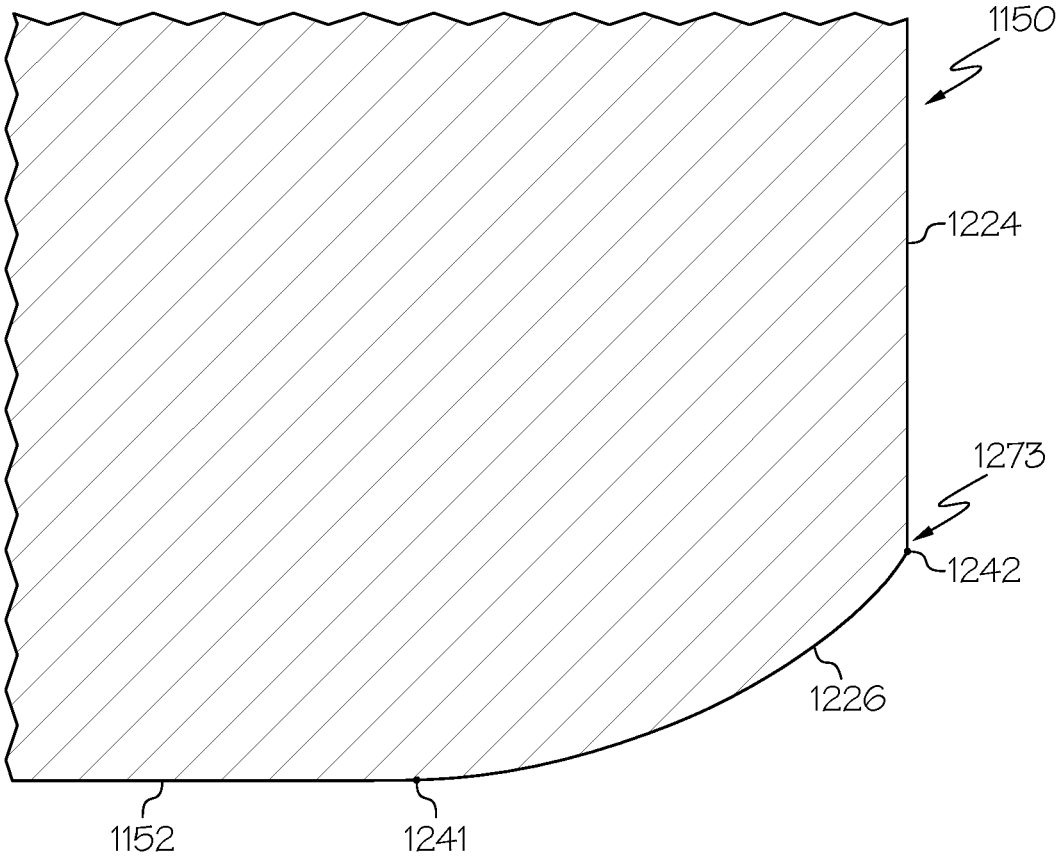
FIG. 5 is an axial cross section of the shroud according to additional embodiments of the present disclosure.

Referring now to FIG. 5, additional embodiments of the shroud 1150 will be discussed. The shroud 1150 may be substantially similar to the shroud 150 of FIGS. 3 and 4 except as noted. Components that correspond to those of FIGS. 3 and 4 are indicated with corresponding reference numbers increased by 1000.

The forward transition 1226 is shown in FIG. 5. The convex contoured shape of the forward transition 1226 at the first intersection 1241 (the external transition intersection) may be a continuous, gradual, and edgeless contoured transition from the shroud surface 1152. However, a slight edge 1273 or corner may remain at the second transition 1242 (the internal transition intersection) with the forward surface 1224 as shown in FIG. 5.

Although not specifically shown, the configuration of FIG. 5 may apply to the trailing transition 230 as well. Specifically, the convex contoured shape of the trailing transition 230 may cause the fifth transition 245 (the external transition intersection) to be continuous, gradual, and edgeless, whereas a slight edge or corner may remain at the fourth transition 244 (the internal transition intersection).

Accordingly, the compressor section 102 may provide various advantages. For example, the clearance region 176 may be relatively small for increasing operating efficiency. A portion of the aft axial fluid flow generated by the compressor section 102 may flow into the grooves 211-214 of the casing treatment 154. Because the trailing transitions 230 of the grooves 211-214 are gradual (i.e., they have relatively large radii), the flow into the grooves 211-214 is directed downstream and slightly inward radially such that there is relatively little drag or resistance to the flow in the downstream direction. Also, the forward surfaces 224 of the grooves 211-214 can effectively increase resistance to reverse axial fluid flow and increase the stall margin of the compressor section 102. In addition, the shroud 150, 1150 exhibits high strength and robustness, for example, if there is contact (i.e., "rubbing") between the blade tip 132 and the shroud 150, 1150. Specifically, the forward and trailing transitions 226, 1226, 230 are shaped to effectively distribute contact forces if there is contact with the blade tip 132. Accordingly, damage to the blade tip 132 and/or damage to the shroud 150, 1150 is less likely. The grooves 211-214 may be dimensioned according to the dimensional relationships discussed above so as to provide both the fluid flow benefits and the increased robustness.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It is understood that various changes may be made in the function and arrangement of elements described in an exemplary embodiment without departing from the scope of the present disclosure as set forth in the appended claims.

We claim:

1. A compressor section of a gas turbine engine, the compressor section defining a downstream direction and an upstream direction, the compressor section comprising:

a shroud with a shroud surface;

a rotor rotatably supported within the shroud, the rotor including a blade that radially terminates at a blade tip, the blade tip opposing the shroud surface, the rotor configured to rotate within the shroud about an axis of rotation;

a serration groove that is recessed into the shroud surface;

the serration groove including a forward portion with a forward transition and a forward surface that faces in the downstream direction, the forward transition being convexly contoured between the shroud surface and the forward surface; and the serration groove including a trailing portion with a taper surface and a trailing transition, the taper surface tapering inward as the taper surface extends from the forward surface to the trailing transition, the trailing transition being convexly contoured between the taper surface and the shroud surface.

2. The compressor section of claim 1, wherein the forward surface and the taper surface are substantially flat.

3. The compressor section of claim 1, wherein:

the forward transition intersects the shroud surface at a first intersection;

the forward transition intersects the forward surface at a second intersection;

the forward surface intersects the taper surface at a third intersection;

the taper surface intersects the trailing transition at a fourth intersection;

the trailing transition intersects the shroud surface at a fifth intersection;

the forward surface and the shroud surface define an imaginary sixth intersection; and the taper surface and the shroud surface define an imaginary seventh intersection.

4. The compressor section of claim 3, wherein the forward portion has a first dimension measured from the first intersection to the sixth intersection;

wherein the trailing portion has a second dimension measured along the taper surface, the second dimension measured from the third intersection to the seventh intersection; and wherein the first dimension is between approximately five percent (5%) and fifty-five percent (55%) of the second dimension.

5. The compressor section of claim 4, wherein the first dimension is between approximately six percent (6%) and thirteen percent (13%) of the second dimension.

6. The compressor section of claim 3, wherein the trailing portion has a second dimension measured along the taper surface, the second dimension measured from the third intersection to the seventh intersection;

wherein the trailing portion has a third dimension measured along the taper surface, the third dimension measured from the fourth intersection to the seventh intersection; and wherein the third dimension is between approximately five percent (5%) and fifty-five percent (55%) of the second dimension.

7. The compressor section of claim 6, wherein the third dimension is between approximately twenty percent (20%) and forty percent (40%) of the second dimension.

8. The compressor section of claim 3, wherein the trailing portion has a second dimension measured along the taper surface, the second dimension measured from the third intersection to the seventh intersection;

wherein the blade tip defines a chord length dimension between a forward end and an aft end of the blade tip; and wherein the second dimension is between approximately four percent (4%) and twenty-nine percent (29%) of the chord length dimension.

9. The compressor section of claim 3, wherein the trailing portion has a fourth dimension measured from the sixth intersection to the seventh intersection;

wherein the blade tip defines a chord length dimension between a forward end and an aft end of the blade tip; and wherein the fourth dimension is between approximately three percent (3%) and twenty percent (20%) of the chord length dimension.

10. The compressor section of claim 3, wherein the serration groove has a depth dimension measured radially from the sixth intersection to the third intersection;

wherein the blade tip defines a chord length dimension between a forward end and an aft end of the blade tip; and wherein the depth dimension is between approximately five percent (5%) and fifteen percent (15%) of the chord length.

11. The compressor section of claim 3, wherein the trailing portion has a second dimension measured along the taper surface, the second dimension measured from the third intersection to the seventh intersection;

wherein the trailing portion has a fifth dimension measured axially from the seventh intersection to the fifth intersection; and wherein the fifth dimension is between approximately twenty percent (20%) and forty percent (40%) of the second dimension.

12. The compressor section of claim 3, wherein the serration groove is a first serration groove of a plurality of serration grooves recessed into the shroud surface, the plurality of serration grooves including a second serration groove;

wherein the first serration groove defines a groove length dimension distance measured axially from the sixth intersection to the seventh intersection;

wherein the plurality of serration grooves defines a second axial distance measured axially between the fifth intersection of the first serration groove and the first intersection of the second serration groove;

wherein the second axial distance is greater than five percent (5%) of the groove length dimension.

13. The compressor section of claim 3, wherein at least one of the first intersection and the fifth intersection is continuous and gradual; and wherein at least one of the second intersection and the fourth intersection include an edge.

14. The compressor section of claim 1, wherein a minimum radius of the forward transition is, at most, two-fifths (2/5) the minimum radius of the trailing transition.

15. The compressor section of claim 1, wherein the blade tip includes a forward end and an aft end, and wherein the blade tip is curved between the forward end and the aft end.

16. A method of manufacturing a shroud of a gas turbine engine comprising:

forming a shroud surface of the shroud, the shroud surface configured to oppose a blade tip of a rotor rotatably supported within the shroud, the shroud surface defining a downstream direction;

forming a serration groove that is recessed into the shroud surface to include a forward portion with a forward transition and a forward surface that faces in the downstream direction, the forward transition being convexly contoured between the shroud surface and the forward surface, the serration groove including a trailing portion with a taper surface and a trailing transition, the taper surface tapering in an inward direction as the taper surface extends from the forward surface to the trailing transition, the trailing transition being convexly contoured between the taper surface and the shroud surface.

17. The method of claim 16, further comprising removing material from the shroud surface to recess the serration groove into the shroud surface.

18. The method of claim 16, further comprising additively manufacturing the shroud surface and the serration groove concurrently.

19. A compressor section of a gas turbine engine, the compressor section defining a downstream direction and an upstream direction and comprising:

a shroud with a shroud surface;

a rotor rotatably supported within the shroud, the rotor including a blade that radially terminates at a blade tip, the blade tip being curved between a forward end of the blade tip and an aft end of the blade tip, the blade tip opposing the shroud surface, the rotor configured to rotate within the shroud about an axis of rotation;

a casing treatment with a plurality of serration grooves that are recessed into the shroud surface, the serration grooves respectively including a forward portion and a trailing portion;

the forward portion including a forward transition and a forward surface that faces in the downstream direction, the forward transition being convexly contoured between the shroud surface and the forward surface;

the trailing portion including a taper surface and a trailing transition, the taper surface tapering inward as the taper surface extends from the forward surface to the trailing transition, the trailing transition being convexly contoured between the taper surface and the shroud surface;

the forward transition intersecting the shroud surface at a first intersection and intersecting the forward surface at a second intersection;

the forward surface intersecting the taper surface at a third intersection;

the taper surface intersecting the trailing transition at a fourth intersection;

the trailing transition intersecting the shroud surface at a fifth intersection;

the forward surface and the shroud surface defining an imaginary sixth intersection;

the taper surface and the shroud surface defining an imaginary seventh intersection;

the forward portion having a first dimension measured from the first intersection to the sixth intersection;

the trailing portion having a second dimension and a third dimension measured along the taper surface, the second dimension measured from the third intersection to the seventh intersection, the third dimension measured from the fourth intersection to the seventh intersection;

the first dimension being between approximately six percent (6%) and thirteen percent (13%) of the second dimension; and the third dimension being between approximately twenty percent (20%) and forty percent (40%) of the second dimension.

20. The compressor section of claim 19, wherein the blade tip defines a chord length dimension between the forward end and the aft end of the blade tip; and wherein the second dimension is between approximately four percent (4%) and twenty-nine percent (29%) of the chord length dimension.

* * * * *